US007278668B1

(12) United States Patent
Simmons

(10) Patent No.: US 7,278,668 B1
(45) Date of Patent: Oct. 9, 2007

(54) MODULAR GRIPPING ASSISTIVE DEVICE

(76) Inventor: Francesca E. Simmons, 1143 Terrace St., Tallahassee, FL (US) 32303

( * ) Notice: Subject to any disclaimer, the term of this patent is extended or adjusted under 35 U.S.C. 154(b) by 0 days.

(21) Appl. No.: 11/498,551

(22) Filed: Aug. 3, 2006

(51) Int. Cl.
*A46B 17/02* (2006.01)

(52) U.S. Cl. ..... 294/25; 16/422

(58) Field of Classification Search ..... 294/25, 294/58; 16/422, 426, 427, 430; 15/145; 224/218; 403/205; 401/6–8
See application file for complete search history.

(56) References Cited

U.S. PATENT DOCUMENTS 1,612,495 A * 12/1926 De Long ..... 131/258
4,165,896 A 8/1979 Hunt
4,325,187 A * 4/1982 Wasson ..... 30/327
4,559,735 A 12/1985 Batick, Jr.
4,606,484 A 8/1986 Winter et al.
4,926,522 A * 5/1990 Wang ..... 16/427
5,015,116 A * 5/1991 Nardone et al. ..... 403/28
5,329,663 A * 7/1994 Council ..... 15/143.1
5,518,333 A * 5/1996 Cienkus et al. ..... 403/169
5,682,641 A * 11/1997 Newman et al. ..... 16/429
5,791,705 A 8/1998 Romero et al.
6,328,494 B1 12/2001 Moxon
6,394,516 B1 5/2002 Zhuravsky
2004/0143921 A1 7/2004 Borkin

* cited by examiner

*Primary Examiner*—Dean J Kramer
(74) *Attorney, Agent, or Firm*—John Wiley Horton

(57) ABSTRACT

A gripping assistive device which can be used by an individual to utilize various utensils. The device generally includes a handle with a bore passing through the interior. An appendage attaches to the handle and extends outwardly from the handle transversely from the bore. A fastening device such as a screw clamp is employed on the appendage so that the various utensils can be attached to the appendage. A second screw clamp may optionally be employed on one end of the handle so that utensils can be attached directly to the handle. An optional strap for fastening the device to the individual's hand and an optional extension can be provided for individuals with limited arm range mobility.

10 Claims, 4 Drawing Sheets

MODULAR GRIPPING ASSISTIVE DEVICE

CROSS-REFERENCES TO RELATED APPLICATIONS

Not Applicable

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of gripping assistive devices. More specifically, the present invention comprises a modular gripping assistive device which can be easily adapted to assist individuals with various levels of disability.

2. Description of the Related Art

Many individuals have disabilities affecting their fine motor skills. The extent of the disability varies from one individual to another and is dependent on many factors, including the type of disease or injury that causes the disability, the stage of the disease or level of injury, and the effectiveness of rehabilitation efforts. The level of disability may vary from complete disablement of the gross motor skills of the arms to partial disablement of the fine motor skills of the fingers, hands, and/or arms.

Individuals with fine motor skill impairment often need help with gripping various objects such as writing utensils and eating utensils. Many assistive devices have been provided to provide greater independence to individuals suffering from these types of disabilities. These devices are typically customized to suit the individual. For example, some gripping assistive devices are made for individuals who cannot use their fingers to grip while others are made for individuals who can use their fingers to grip but can only move their arms over a limited range.

Despite the existence of these devices, in many cases there is a need for a gripping assistive device which can be easily adapted to the individual's specific disability. For example, some individuals suffer from progressive disabilities in which the nature of the disability changes over time. These individuals may need to regularly obtain new gripping assistive devices as the level and nature of the disability changes. Also, some instructors and rehabilitation specialists work with many different students or patients. In these situations, the students and patients typically have different levels of disability. In order to meet the needs of these individuals the instructor or rehabilitation specialist often needs an assortment of aides. Accordingly, it would be desirable to provide a simple, adaptable gripping aid that can be used by individuals with various levels of physical impairment.

BRIEF SUMMARY OF THE PRESENT INVENTION

The present invention comprises a gripping assistive device which can be used by an individual to hold various utensils. The device generally includes a handle with a bore passing through the interior. An appendage attaches to the handle and extends outwardly from the handle transversely from the bore. A fastening means such as a screw clamp is employed on the appendage so that the various utensils can be attached to the appendage. A second screw clamp may optionally be employed on one end of the handle so that utensils can be attached directly to the handle. An optional strap for fastening the device to the individual's hand and an optional extension can be provided for individuals with limited arm range mobility.

REFERENCE NUMERALS IN THE DRAWINGS

| | | | |
|---|---|---|---|
| 10 | gripping assistive device | 12 | handle |
| 14 | screw clamps | 16 | strap |
| 18 | appendage | 20 | handle interior |
| 22 | appendage interior | 24 | head |
| 26 | clamp surface | 28 | brush |
| 30 | hand | 32 | extension |
| 34 | screw bore | | |

DETAILED DESCRIPTION OF THE INVENTION

Figure 1:
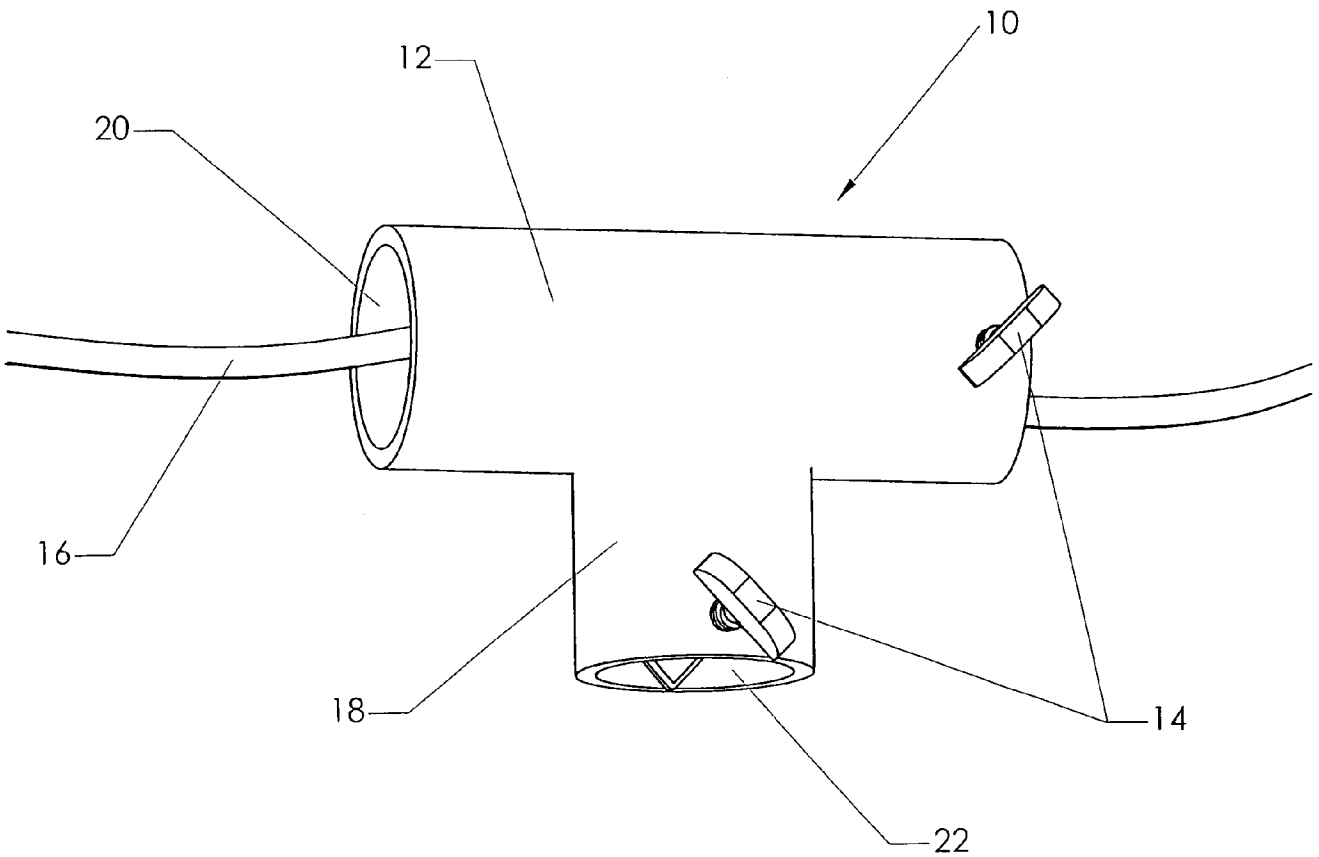
FIG. 1 is a perspective view, showing the present invention.

The present invention, gripping assistive device 10, is shown in FIG. 1. Gripping assistive device 10 generally includes appendage 18 which is attached to the middle of handle 12 and extends transversely from handle 12 so that the two components together form a T-shaped structure. Handle 12 includes a bore through handle interior 20 which receives strap 16, the purpose of which will be explained subsequently. Appendage interior 22 is also hollow. The reader will appreciate that a simple T-shaped polyvinyl chloride (PVC) pipe connector may be used to create the T-shaped structure. Screw clamps 14 are employed on one end of handle 12 and on appendage 18 for clamping objects to gripping assistive device 10 as will be explained subsequently.

Figure 2:
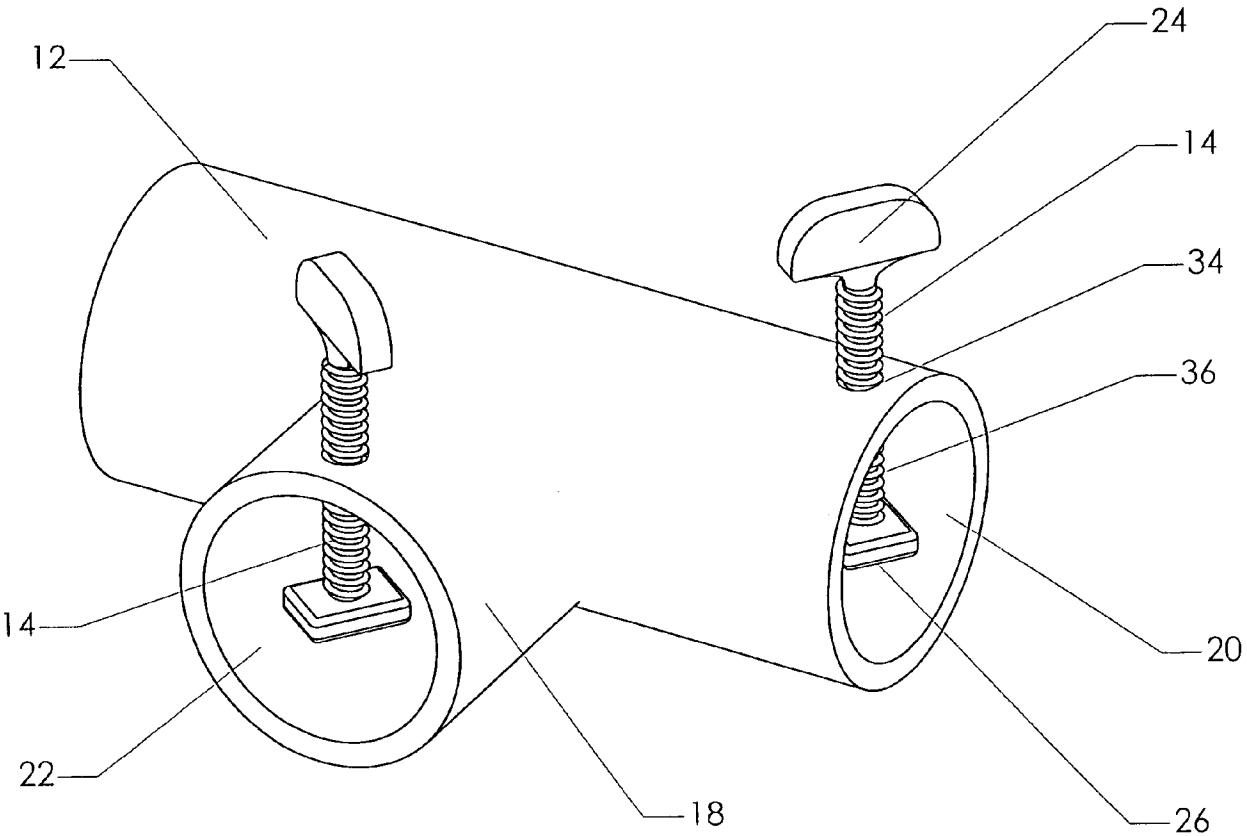
FIG. 2 is a perspective view, showing the present invention.

Gripping assistive device 10 is shown from another perspective in FIG. 2. Screw clamp 14 generally includes threaded body 36 which passes from the exterior of handle 12 into handle interior 20 via screw bore 34. Head 24 is attached to the portion of the threaded body that extends out from the exterior of handle 12. Clamp surface 26 is attached to the bottom of threaded body 36 that extends into handle interior 20. When the user turns head 24, the threaded body causes clamp surface 26 to move toward or away from the portion of handle interior 20 opposite screw bore 34 depending on the direction head 24 is turned. Another screw clamp 14 is employed on appendage 18 and functions the same as screw clamp 14 on handle 12.

Figure 3:
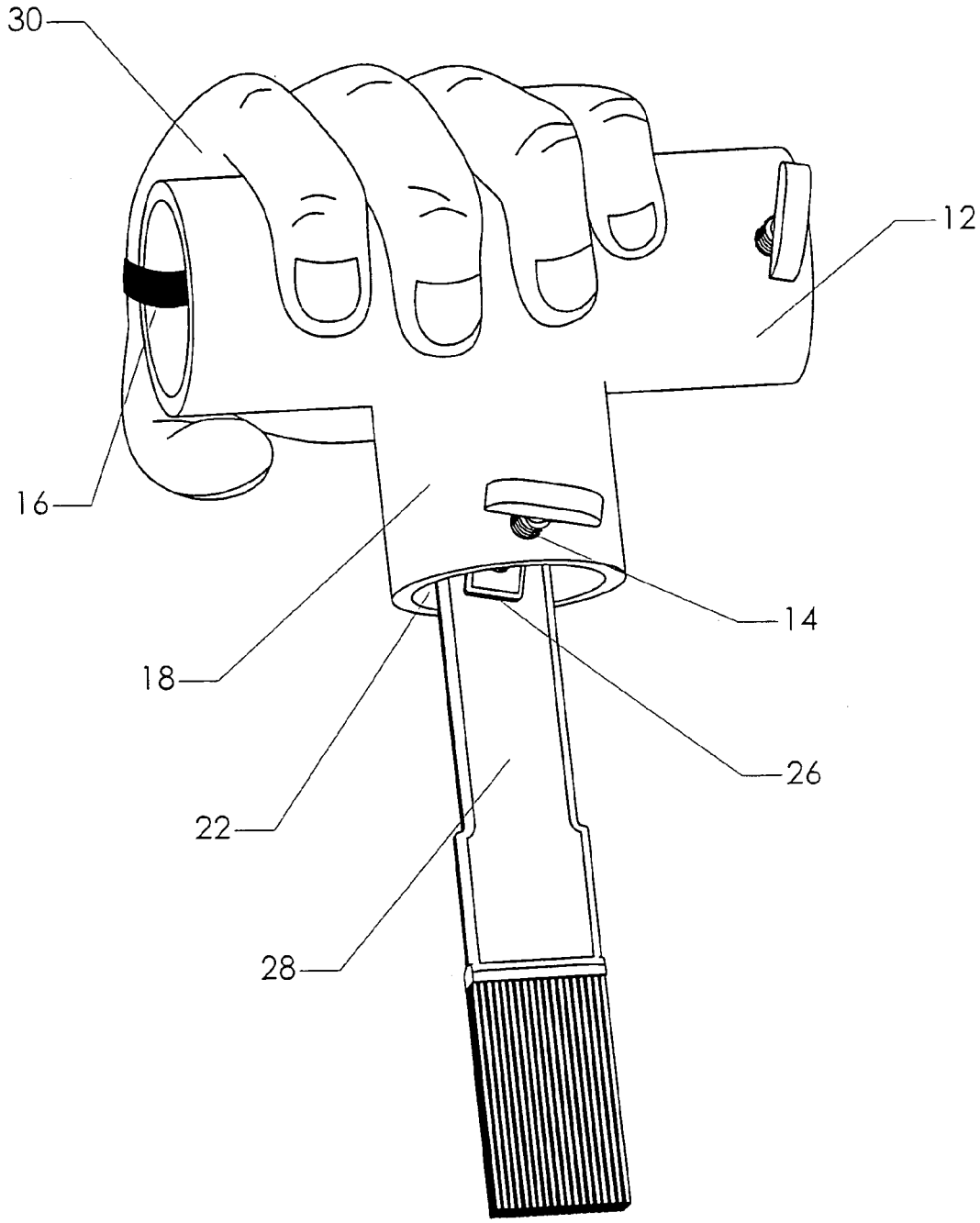
FIG. 3 is a perspective view, showing the present invention in use.

FIG. 3 shows the present invention in use. Screw clamp 14 is used to attach brush 28 to appendage 18. Although brush 28 is illustrated, the reader will appreciate that other utensils and objects may also be used including pens, pencils, forks, and spoons. To attach brush 28, the user places the wand of brush 28 between clamping surface 26 and appendage interior 22 and turns head 24 until brush 28 is secured to appendage 18. The user then wraps the fingers of hand 30 around handle 12 of the device and strap 16 is secured around the back of the user's hand. This configuration is helpful for individuals who do not have a very strong grip or otherwise have difficulty in manipulating utensils. Strap 16 may also be used to attach gripping assistive device 10 to the back side of hand 30. This configuration may be particularly helpful for individuals who cannot lift their wrist.

Strap 16 can be secured to the user's hand in many different ways. For example, it may simply be tied to the user's hand. Strap 16 may also be fastened together with VELCRO, snaps or other fasteners. Alternatively, strap 16 may be made of an elastic material formed into a continuous band which can be wrapped around the user's hand and elastically holds gripping assistive device 10 to the user's hand. In addition, other methods of securing the device to the user's hand may also be used.

Although the utensil is shown attached to screw clamp 14 on appendage 18 in FIG. 3, it should also be understood that the utensil could be attached to screw clamp 14 provided on the end of handle 12. This configuration is particularly helpful when using a spoon or fork. The utensil would then be aligned with handle 12.

Figure 4:
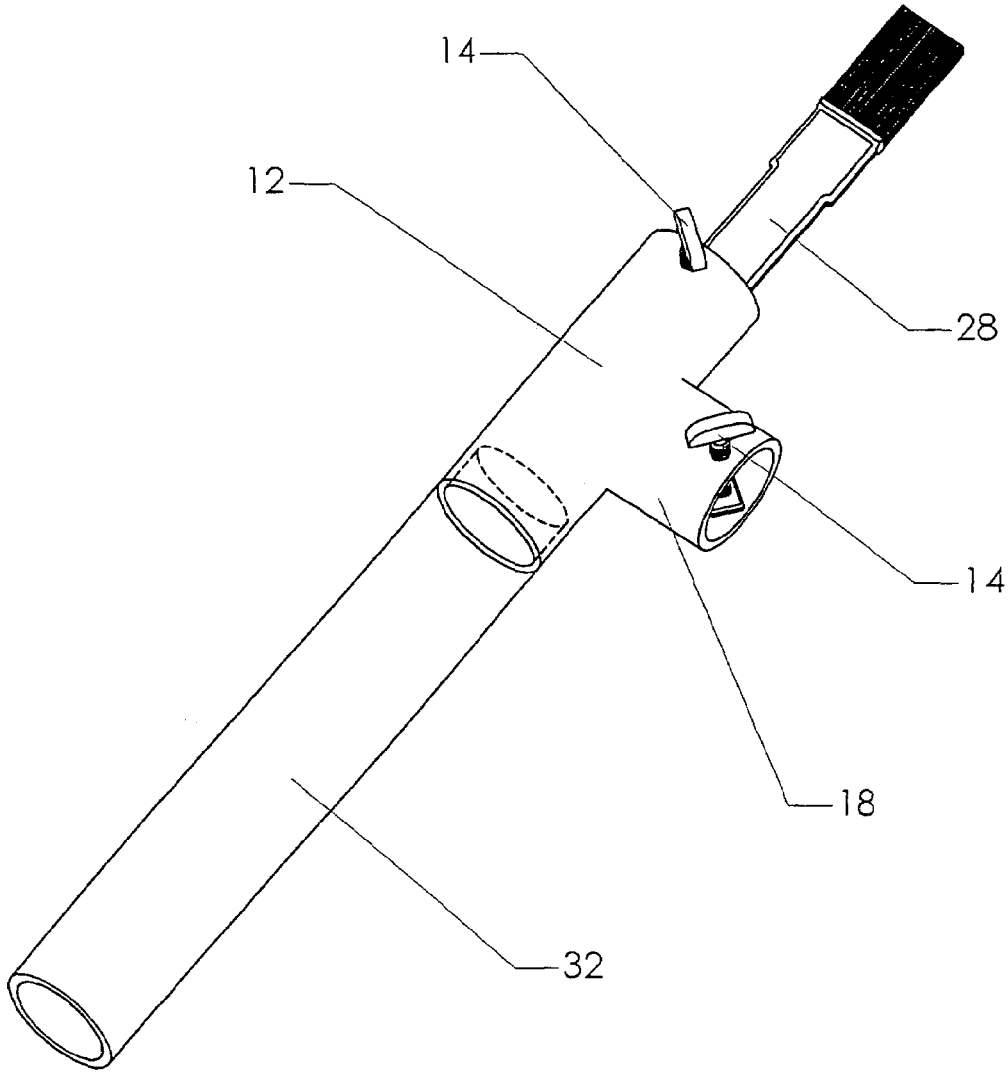
FIG. 4 is a perspective view, showing the present invention used with an extension.

FIG. 4 shows how extension 32 can be employed with gripping assistive device 10 for increased functionality. Extension 32 is an elongated member which may be attached to one end of handle 12. If a T-shaped PVC pipe connector is used for gripping assistive device 10, a segment of PVC pipe having the appropriate outside diameter for frictional engagement with the connector can be used. As illustrated in FIG. 4, extension 32 can be inserted into handle 12 until the components are firmly attached together. A utensil, such as brush 28, can then be attached to either screw clamp 14 in handle 12 or screw clamp 14 in appendage 18. For example, for writing on a vertical surface, a utensil may be attached to screw clamp 14 on handle 12. For writing on a horizontal surface, a utensil may be attached to screw clamp 14 on appendage 18. To use extension 32, the user simply grabs the end of extension 32 opposite handle 12 and moves the assembly as desired. These configurations are most helpful for individuals whose arm range mobility is limited.

Although the preceding descriptions contain significant detail they should not be viewed as limiting the invention but rather as providing examples of the preferred embodiments of the invention. For example, other fastening means aside from screw clamps 14 can be used for attaching objects to gripping assistive device 10 including other clamping devices, straps, VELCRO, and other fasteners. Accordingly, the scope of the invention should be determined by the following claims, rather than the examples given.

I claim:

1. A gripping assistive device for a user having a hand comprising:

a. a handle having a first end, a second end, a medial section therebetween, an interior, an exterior, and a bore opening into said interior of said handle and passing from said first end to said second end;

b. an appendage having a first end and a second end, said first end of said appendage connected to said medial section of said handle and said second end of said appendage extending transversely from said handle with respect to said bore, said second end of said appendage opening into a hollow interior, said hollow interior extending throughout said appendage;

c. a first fastening device for fastening a utensil to said gripping assistive device, said first fastening device positioned on said appendage and adapted to fasten said utensil to said appendage; and d. a strap, said strap passing through said bore of said handle and adapted to wrap around said hand of said user thereby attaching said gripping assistive device to said hand.

2. The gripping assistive device of claim 1, further comprising a second fastening device for fastening said utensil to said gripping assistive device, said second fastening device positioned on said handle proximal to said second end and adapted to fasten said utensil to said handle.

3. The gripping assistive device of claim 2, said second fastening device comprising a screw clamp.

4. The gripping assistive device of claim 2, further comprising an extension, said extension having a first end and a second end, said first end of said extension adapted to removably attach to said first end of said handle.

5. The gripping assistive device of claim 1, said first fastening device comprising a screw clamp.

6. The gripping assistive device of claim 5, further comprising an extension, said extension having a first end and a second end, said first end of said extension adapted to removably attach to said first end of said handle.

7. The gripping assistive device of claim 1, further comprising an extension, said extension having a first end and a second end, said first end of said extension adapted to removably attach to said first end of said handle.

8. A gripping assistive device for a user having a hand comprising:

a. a handle having a first end, a second end, a medial section therebetween, an interior, an exterior, and a bore opening into said interior of said handle and passing from said first end to said second end;

b. an appendage having a first end and a second end, said first end of said appendage connected to said medial section of said handle and said second end of said appendage extending transversely from said handle with respect to said bore, said second end of said appendage opening into a hollow interior, said hollow interior extending throughout said appendage;

c. a first fastening device for fastening a utensil to said gripping assistive device, said first fastening device positioned on said handle proximal to said second end and adapted to fasten said utensil to said handle; and d. a strap, said strap passing through said bore of said handle and adapted to wrap around said hand of said user thereby attaching said gripping assistive device to said hand.

9. The gripping assistive device of claim 8, said first fastening device comprising a screw clamp.

10. The gripping assistive device of claim 8, further comprising an extension, said extension having a first end and a second end, said first end of said extension adapted to removably attach to said first end of said handle.

* * * * *